United States Patent [19]

Schlotter et al.

[11] 4,294,452

[45] Oct. 13, 1981

[54] TARGET BACKSTOP

[75] Inventors: Harold J. Schlotter, Springfield; Leroy Young, Sedalia, both of Mo.

[73] Assignee: Champion International Corporation, Stamford, Conn.

[21] Appl. No.: 98,657

[22] Filed: Nov. 29, 1979

[51] Int. Cl.[3] ..... F41J 1/00

[52] U.S. Cl. ..... 273/403

[58] Field of Search ..... 273/403, 404, 408

[56] References Cited

U.S. PATENT DOCUMENTS 3,164,384 1/1965 Stewart ..... 273/403
3,512,778 5/1970 Allen ..... 273/403

FOREIGN PATENT DOCUMENTS 479348 1/1938 United Kingdom ..... 273/403
501457 2/1940 United Kingdom ..... 273/404

*Primary Examiner*—Anton O. Oechsle
*Attorney, Agent, or Firm*—Evelyn M. Sommer

[57] ABSTRACT

A target backstop for supporting a target in which projectiles may be embedded comprises a wall member and a plug. Both the wall member and plug are formed of corrugated material. The wall member has a cavity formed therein which opens on its front face. The plug is adapted to be releasably coupled within the cavity. A target may be placed over the plug. When the area behind the target is shot out (i.e., the plug), such area may be easily restored by replacing the plug without having to rearrange or replace the entire wall.

13 Claims, 6 Drawing Figures

TARGET BACKSTOP

The present invention relates to a target backstop for supporting a target into which projectiles are embedded. The target backstop may be used in such fields as archery and pistol and rifle shooting.

Known and conventional target backstops comprise a plurality of straw bales. The straw bales are arranged one on top of another and adjacent each other so as to form a wall. When the bale behind the target is shot out, the bales must be rearranged and the damaged bale replaced. Furthermore, each new season an entirely new set of bales must be purchased to replace the old set.

Accordingly, it is an object of the present invention to provide a target backstop in which the damaged areas may be easily replaced while the remainder thereof would last indefinitely. In particular, it is the object of the present invention to provide a stairstep display rack which has a wall member having at least one cavity formed therein, and a plug adapted to be releasably coupled within the cavity which may be used as a target area and easily replaced.

Another object of the present invention is to provide a target backstop which is strong, reusable, simple to assemble, inexpensive and easy to manufacture and maintain, and adaptable to a wide variety of sports.

The foregoing objects are attained by providing a target backstop for supporting a target in which projectiles may be embedded comprising a wall member formed of corrugated material having a front face and at least one cavity formed therein opening on the front face, and a plug formed of corrugated material and adapted to be coupled releasably within the cavity.

A further aspect and object of the present invention is to provide means within the backstop to aid in absorbing the shock of the impact of the projectiles on the plug to increase the life of the plug and to back-up the plug. In particular, it is the object of the present invention to provide a resilient member in the backstop cavity behind the plug to absorb the impact and back-up plug.

Other objects, advantages, and salient features of the present invention will become apparent from the following detailed description, which when taken in conjunction with the annexed drawings, discloses preferred embodiments of the present invention.

Referring to the drawings which form a part of this disclosure:

Figure 1:
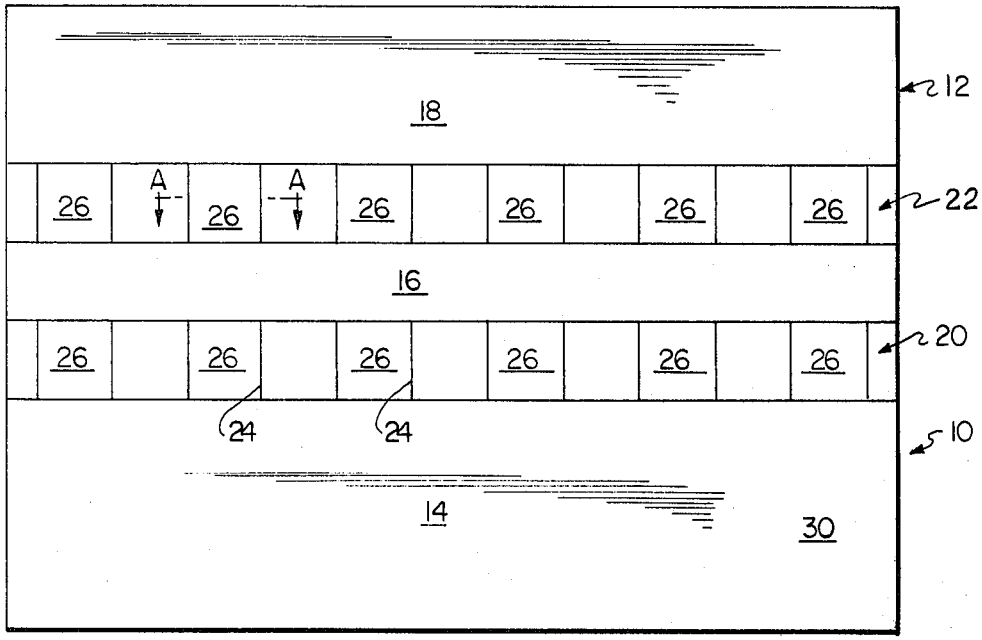
FIG. 1 is a front elevational view of a target backstop in accordance with the present invention.

Referring to FIG. 1, the target backstop 10 of the present invention comprises a wall member 12 having five sections.

The sections 14, 16, 18 are formed of a plurality of relatively large corrugated sheets which are laid on top of one another in brick fashion to the appropriate height. A typical sheet size is 71 inches by 20 inches and should be of the 42, 26, 42, 26, 42 variety or better. In a typical wall, the section 14 is 3 feet high, the section 16 is 1 foot high and the section 18 is two feet high. The width of the wall may be of any dimension desired, but is typically within the range of 6 feet to 40 feet in width.

Separating the sections 14, 16, 18 are glued base sheet sections 20, 22. The base sheet sections 20, 22 are made up of a plurality of blocks. Each block is formed from a plurality of base sheets of corrugated material which are laid one on top of another and glued together so as to form a block of desired height, usually 12 inches. Since the typical sheet is 71 inches by 20 inches, the finished block is usually 71 inches by 20 inches by 12 inches. Each block is formed with a plurality of cavities 24 into which plugs 26 are releasably coupled.

The plugs 26 have a trapezoid-shaped cross section. Like the blocks for the base sheet sections 20, 22, the plugs 26 are formed from a plurality of sheets of corrugated material which are cut to the desired shape (i.e., trapezoid), laid one on top of another and glued together. Typically, the plug 26 is formed to a height of 12 inches and is approximately 12 inches wide at the widest point.

Figure 2:
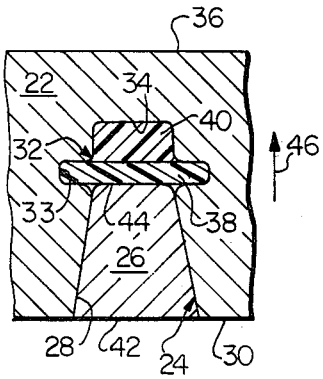
FIG. 2 is an enlarged, fragmentary cross-sectional view taken along lines A—A of FIG. 1 illustrating the details of the wall member cavity and plug according to one embodiment of the present invention.
Figure 3:
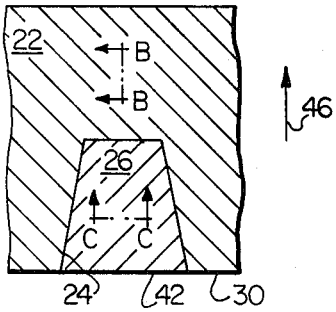
FIG. 3 is an enlarged, fragmentary cross-sectional view taken along lines A—A of FIG. 1 illustrating the details of the wall member cavity and plug according to another embodiment of the present invention.

FIGS. 2 and 3 illustrate two alternative arrangements for mounting of the plugs within the base sheet sections 20, 22. In forming the blocks for the base sheet sections 20, 22, each sheet used to form the blocks may be formed with a cutout according to the configuration shown in FIG. 2 or FIG. 3 so that when the sheets are stacked and glued a cavity with the desired configuration is formed therein which opens on the front face of the wall member 12.

The embodiment shown in FIG. 2 is formed to provide a shock absorber behind the plug 26. In this embodiment, the cavity 24 is divided into two parts, a front portion 28 adjacent the front face 30 of the wall member 12, and a rear portion 32 spaced from the front face 30. The rear portion 32 includes a recessed section or recess 33 and a rear chamber 34 located behind the recessed section 33. In cross section, the front portion 28 of the cavity 24 is in the shape of a trapezoid. The lateral sides of the front portion 28 taper inwardly from the front face 30 towards the rear face 36 of the wall member 12 to mate with the tapered lateral sides of the plugs 26.

The cross section of the recessed section 33 of the rear portion 32 is greater than the cross section of the front portion 28 at a position adjacent the rear portion 32. The rear chamber 34 is of smaller cross section than the recessed section 33. Typically, the recessed section 33 is 13 inches wide and $1\frac{1}{2}$ inches deep, the rear chamber 34 is 9 inches wide and 2 inches deep, and the front portion 28 is 6 inches wide adjacent the recessed section 33.

A resilient member 38 is mounted in the recessed section 33 and is entrapped therein. The rear chamber 34 may be left empty or filled with such soft resilient material as urethane or sponge rubber 40.

When assembled, the plug 26 has its front surface 42 lying substantially in the same plane as the front face 30.

The rear surface 44 of the plug 26 abuts against the forward face of the resilient member 38.

By this arrangement, the resilient member 38 with or without the resilient material 40 will absorb the shock of impact resulting from the penetration of projectiles into the plug 26. By absorbing the shock in the plug 26, the life of the plug 26 is extended. Even after the plug 26 has been shot out, the resilient member 38 and/or the resilient material 40 can serve as a backstop for the target.

A simplified embodiment of the invention is illustrated in FIG. 3. In the embodiment of FIG. 3, there is no shock absorbing means. The cavity 24 in this embodiment has a trapezoid-shaped cross section and is similar in the form to the front portion 28 of the embodiment of FIG. 2, but without the rear portion 32. The plugs 26 for each of the embodiments are identical.

Another aspect of the present invention is the orientation of the corrugations of the corrugated material employed to form the target backstop 10. In each of the sections 14, 16, 18, 20, 22 and in the plugs 26, the corrugations extend from front to rear and perpendicularly relative to the front face 30.

Figure 4:
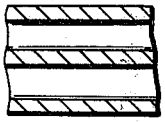
FIG. 4 is an enlarged, fragmentary cross-sectional view taken along lines B—B of FIG. 3 graphically illustrating the corrugated material of the plug and wall member.
Figure 5:
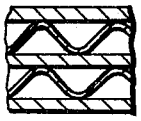
FIG. 5 is an enlarged, fragmentary cross-sectional view taken along lines C—C of FIG. 3 graphically illustrating the corrugated material of the plug and wall member.

FIGS. 4 and 5 are provided to illustrate the direction of the corrugations. Although FIGS. 4 and 5 only show the direction of corrugations in the base sheet section 22 and the plug 26, they are intended to be exemplary of all corrugations in the target backstop. Arrows 46 indicate the direction of the corrugations.

Figure 6:
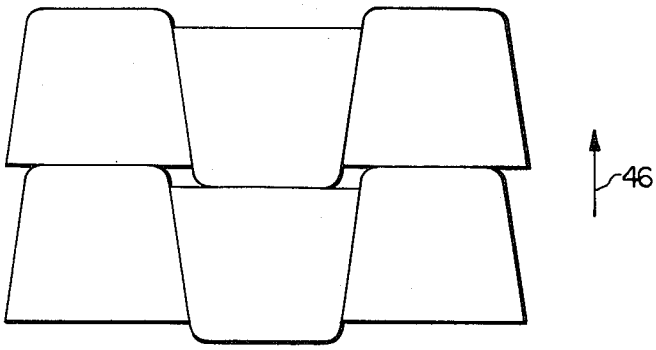
FIG. 6 is a plan view illustrating the cutout for forming the plug.

FIG. 6 illustrates the form for cutting out corrugated sheets to form the plug 26. Once the cuts have been made the appropriate pieces are stacked and glued to form the plug 26.

The corrugated material employed to form the target backstop 10 may be cardboard or other paperboard.

In gluing the cut corrugated sheets to form the base sheet section blocks and the plugs 26, it is critical that they be glued properly and accurately. If too much adhesive is used to form the blocks and plugs they will become too hard to permit proper embedding of projectiles therein. If too little adhesive is used, the parts will tend to fall apart.

While particularly advantageous embodiments have been chosen to illustrate the invention, it will be understood by those skilled in this art that various changes and modifications can be made therein without departing from the scope of the invention as defined in the appended claims.

What is claimed is:

1. A target backstop for supporting a target in which projectiles may be embedded comprising a plug;

a wall member formed of corrugated material having a front face, a rear face, and at least one cavity formed therein opening on said front face, said cavity comprising a front portion adjacent said front face for receiving said plug and a rear portion remote from said front face;

a resilient member formed of a heavy rubberized material mounted in said rear portion to abut said plug when said plug is mounted in said front portion, said rear portion having a rear chamber on the side of said resilient member remote from said front face;

said plug being formed of corrugated material and adapted to be coupled releasably within said cavity.

2. A target backstop according to claim 1, wherein said wall member has a plurality of cavities opening on said front face and plugs of corrugated material releasably coupled therein.

3. A target backstop according to claim 1, wherein said cavity has lateral sides which taper inwardly from said front fact toward said rear face; and said plug has a front surface and a back surface and has lateral sides which taper inwardly from said front surface to said back surface, said front surface lying in substantially the same plane as said front face when said plug is mounted in said cavity.

4. A target backstop according to claim 1, wherein the corrugations of said wall member extend perpendicularly relative to said front face.

5. A target backstop according to claim 1, wherein the corrugations of said plug extend perpendicularly relative to said front surface.

6. A target backstop according to claim 1, wherein the portion said wall member adjacent said cavity is formed of at least one block; said block comprises a plurality of sheets of corrugated material laid one on top of another and secured together by an adhesive.

7. A target backstop according to claim 1, wherein said plug comprises a plurality of sheets of corrugated material laid one on top of another and secured together by an adhesive.

8. A target backstop according to claim 1, wherein said rear chamber is filled with a relatively soft, resilient material.

9. A target backstop according to claim 8, wherein said relatively soft material is selected from the group consisting of urethane and sponge rubber.

10. A target backstop according to claim 1, wherein said rear portion has a recessed section with a cross section greater than the cross section of said front portion at a position adjacent said rear portion; said resilient member being in the form of a disc which is fitted in said recessed section.

11. A target backstop according to claim 1, wherein said corrugated material is paperboard.

12. A target backstop for supporting targets in which projectiles may be embedded comprising:

a wall member formed of corrugated paperboard having a front face, a rear face, and a plurality of cavities formed therein, said cavities opening on said front face and arranged in at least one horizontal row; each cavity having lateral sides which taper inwardly from said front face toward said rear face; the portion of said wall member adjacent said cavities being formed of a plurality of blocks, said blocks formed of a plurality of sheets of corrugated paperboard laid one on top of another and secured together by an adhesive; and a plug releasably mounted in each of said cavities; each plug formed of a plurality of sheets of corrugated paperboard laid one on top of another and secured together by adhesive, and having a front surface, a back surface and lateral sides which taper inwardly from said front surface to said back surface, said front surface being substantially coplanar with said front face;

said corrugated paperboard of said wall member and plugs having corrugations which extend substantially perpendicularly to said front face.

13. A target backstop according to claim 12, wherein each cavity comprises a front portion adjacent said front face which receives its plug and a rear portion spaced from said front face, each rear portion including a recessed section with a cross section greater than the cross section of its front portion at a position adjacent thereto, each rear portion also including a rear chamber behind and of smaller cross section than its recessed section;

a disc-shaped resilient member is mounted in each recessed section to abut said rear surface of its plug, each resilient member being formed of heavy rubberized material; and each rear chamber is filled with relatively soft, resilient material.

* * * * *